United States Patent [19]

Solypa

[11] 4,316,627

[45] Feb. 23, 1982

[54] IMPLEMENT FOR COLLECTING PET MANURE

[76] Inventor: Joseph Solypa, 11771 Oldfield Ave., Richmond, British Columbia, Canada, V6X 1M3

[21] Appl. No.: 169,149

[22] Filed: Jul. 15, 1980

[51] Int. Cl.[3] ..... A01K 29/00

[52] U.S. Cl. ..... 294/1 BA; 15/257.6; 294/55

[58] Field of Search ..... 294/1 B, 1 BA, 1 BB, 294/19 R, 50.8, 50.9, 55, 55.5; 15/104.8, 257.1, 257.4, 257.6, 257.7; 56/400.04, 400.11, 400.12, 400.13, 400.16, 400.21

[56] References Cited

U.S. PATENT DOCUMENTS

| | | | |
|---|---|---|---|
| 501,430 | 7/1893 | Knight | 56/400.13 |
| 1,866,754 | 7/1932 | Crane | 56/400.13 |
| 3,052,214 | 9/1962 | Johnson | 294/1 BA |
| 3,868,135 | 2/1975 | Magliaro | 15/257.6 X |
| 4,005,892 | 2/1977 | Williams | 294/55 X |
| 4,019,768 | 4/1977 | Niece | 294/55 X |
| 4,143,899 | 3/1979 | Wetherall et al. | 294/1 BA X |

FOREIGN PATENT DOCUMENTS

| | | | |
|---|---|---|---|
| 549203 | 11/1957 | Canada | 56/400.12 |
| 319484 | 9/1918 | Fed. Rep. of Germany | 294/55 |
| 658177 | 3/1938 | Fed. Rep. of Germany | 294/55 |
| 2356768 | 3/1978 | France | 294/1 BA |

*Primary Examiner*—Johnny D. Cherry
*Attorney, Agent, or Firm*—Carver & Co.

[57] ABSTRACT

An implement for collecting pet manure and similar refuse has an elongate handle with a bottom end. A scoop is mounted at the bottom end of the handle and has a bottom edge. The implement has a cover and means for moving the cover to cover the scoop. A plurality of adjacent, parallel members extend forwardly from the bottom edge of the scoop. The members are wire-like, permitting the members to be inserted under the manure and then lift the manure when the handle is raised.

4 Claims, 5 Drawing Figures

IMPLEMENT FOR COLLECTING PET MANURE

BACKGROUND OF THE INVENTION

Field of the Invention

This invention relates to an implement for collecting pet manure, the implement having a plurality of adjacent, parallel members for inserting under the manure and then lifting the manure.

Previous patents disclose a variety of implements for collecting pet manure and similar refuse. A number of these earlier patents employ finger-like members to retrieve the manure, for example U.S. Pat. No. 2,579,536 to Barr; No. 4,143,899 to Wetherall and No. 3,879,079 to Nicholas. Nicholas discloses a solid waste collector and container which has a scoop and integral container with a hinged lid cooperating with the container. West German Pat. No. 2,306,593 discloses a refuse container having a sliding door which is actuated from the handle. U.S. Pat. No. 3,942,831 to Sosnove and No. 4,005,892 to Williams both show waste collectors with hinged scoops which can be swung relative to a handle. U.S. Pat. No. 2,579,536 to Barr and No. 3,617,084 to Mares both disclose handles fitted with dual-hinged curved tongs or clamshell-type pickers.

Despite the prior art, the need still remains for an improved implement for collecting pet manure and similar refuse which is extremely susceptible to disintegration and spreading. To accomplish this, such an improved implement should be capable of being inserted under the manure without disturbing it and then lifting it so that it can be directed into a scoop or the like in a relatively undisturbed state. Trying to insert a normal scoop, even with finger-like members on the forward edge, frequently causes the manure to be broken up or spread on the ground, in which state it is very difficult to recover.

SUMMARY OF THE INVENTION

According to the invention, an implement for collecting pet manure and similar refuse comprises an elongate handle with a bottom end. A scoop is mounted at the bottom end of the handle and has a bottom edge. There is a cover and means for moving the cover to cover the scoop. A plurality of adjacent, parallel members extend forwardly from the bottom edge of the scoop. The members are wire-like, permitting the members to be inserted under the manure and then lift the manure when the handle is raised.

For example, the parallel members may have ends adjacent the bottom edge of the scoop mounted on a hinge member hingedly connected to the bottom edge of the scoop. The parallel members and hinge member comprise said cover.

The plurality of wire-like members, as provided by the invention, are capable of being inserted under the manure and lifting it in a relatively undisturbed state. Consequently, the manure can be directed into the scoop instead of being broken up or spread as could well occur with prior art devices not having such wire-like members.

DESCRIPTION OF THE PREFERRED EMBODIMENT

Figure 2:
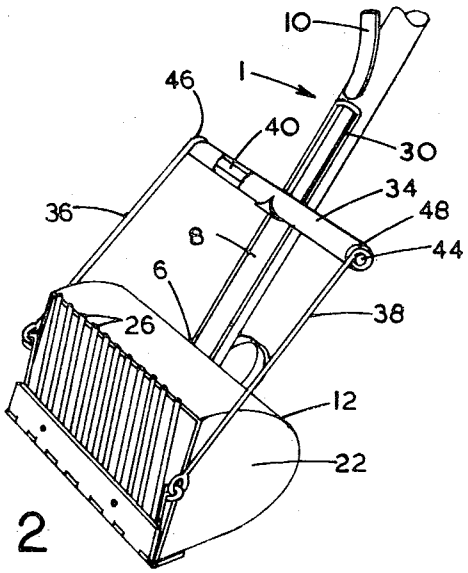
FIG. 2 is an isometric view equivalent to FIG. 1 with the wire-like members in the closed position.
Figure 1:
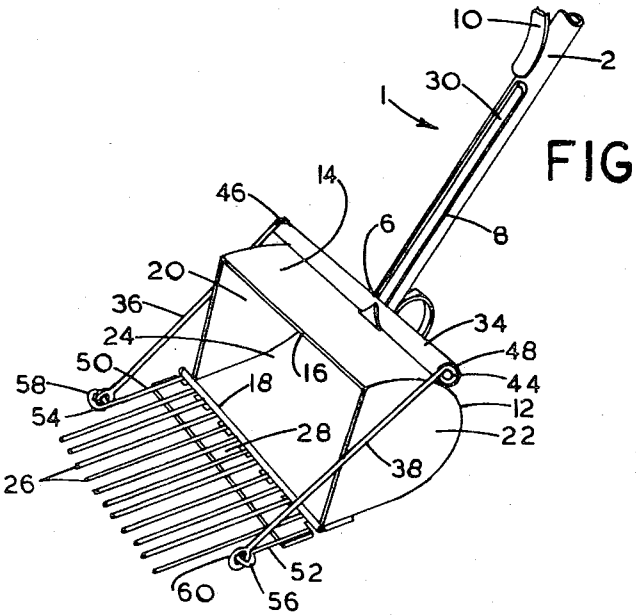
FIG. 1 is a fragmentary isometric view of an implement for collecting pet manure according to an embodiment of the invention and showing the lower end of the handle, the scoop and the wire-like members in the open position.
Figure 3:
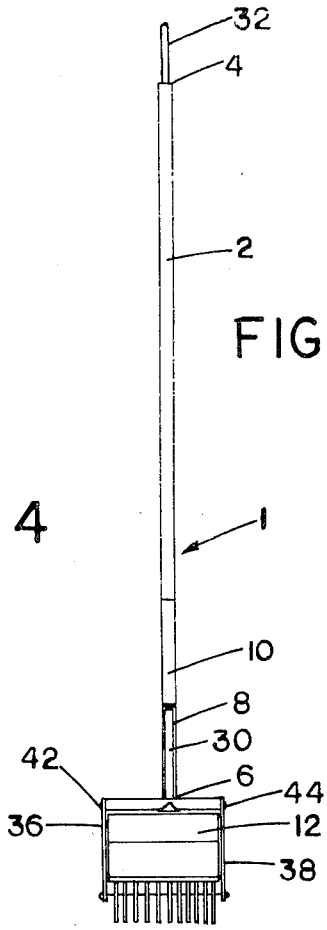
FIG. 3 is a front elevational view of the implement shown in FIG. 1.

Referring to the first embodiment of the invention shown in FIGS. 1 to 3, the implement 1 for collecting pet manure and similar refuse has an elongate, outer handle 2 which comprises a tube, preferrably made of metal. The tube has a top end 4 and a bottom end 6. There is an elongate opening 8 in the tube 2 adjacent the bottom end 6 and facing the front of the implement. A curved metal strap 10 is secured to the front of the tube 2 above opening 8 by soldering or welding and provides an auxiliary handle for manipulating the implement.

A scoop 12 is mounted at the bottom end of the tube 2. The scoop is formed by a curved sheet metal member 14 having a top edge 16 and a bottom edge 18 as shown in FIG. 1. The sheet metal sides 20 and 22 are connected to member 14 by welding or soldering. A front opening 24 is thus formed extending between the top and bottom edges and the sides of the scoop.

A plurality of adjacent, parallel members 26 extend forwardly from the bottom edge 18 of the scoop. The members are wire-like and, in this embodiment, comprise metal wire approximately $\frac{1}{8}$ inch in diameter. The ends of the members 26 adjacent the bottom edge 18 of the scoop are mounted on a hinge member 28 by soldering or welding. The hinge member is hingedly connected to the bottom edge 18 of the scoop.

There is an inner handle 30 slidably received within the tube for relative axial movement. In this embodiment, the inner handle 30 comprises a tube having a diameter slightly smaller than that of tube 2. The inner handle has a top portion 32 extending beyond the top end 4 of the tube 2. A transverse member or tube 34 is connected to the inner handle 30 at the elongate opening 8 in the tube 2. The transverse tube is parallel to the edges 16 and 18 of the scoop.

There is a pair of links 36 and 38 extending between the transverse tube 34 and hinge member 28. A bar 40 extends co-axially through tube 34 and has heads 42 and 44 formed on opposite ends thereof. The upper ends of links 36 and 38 have loops 46 and 48, respectively, formed about rod 40 to provide a pivotal connection with the transverse tube. Wire-like members 50 and 52 are connected to the hinge member 28 in the same manner as members 26. Members 50 and 52 are adjacent the sides 20 and 22 of the scoop and have loops 54 and 56 formed on the front ends thereof. Loops 58 and 60 are formed on the bottom ends of links 36 and 38 and interlock with loops 54 and 56 to provide a pivotal connection between the links and the hinge member.

As may be observed by comparing FIGS. 1 and 2, the plurality of members 26 and hinge member 28 together form a cover for the scoop 12. The inner handle 30, transverse tube 34 and links 36 and 38 provide means for moving the cover to the position shown in FIG. 2 where the scoop is covered.

When the top portion 32 of the inner handle 30 is pushed downwardly until the transverse tube 34 contacts the scoop 12, links 36 and 38 move the hinge member and the members 26 to the position shown in FIG. 1 and FIG. 3. The members 26 extend forwardly so they can be held generally parallel to the ground or other surface. Because of their wire-like nature, members 26 are capable of being inserted under pet manure or similar refuse without breaking up or disturbing the same. Once the members are under the manure, the top portion 32 of the inner handle is pulled upwardly relative to the tube 2, causing the members 26 and hinge member 28 to pivot upwardly about the bottom edge 18 of the scoop, thus directing the manure into the scoop. When the members 26 contact the top edge 16 of the scoop, the hinged member and wire-like members 26 form a cover to retain the manure within the scoop.

Figure 4:
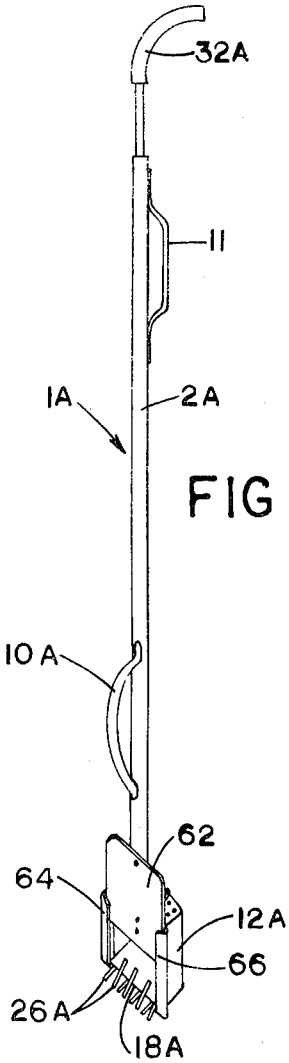
FIG. 4 is an isometric view of an alternative embodiment of the invention having a sliding cover for the scoop.

FIG. 4 shows an implement 1A for collecting pet manure and similar refuse. Parts equivalent to those of the embodiment of FIGS. 1 to 3 have the same number with the additional letter "A". Implement 1A has an elongate handle 2A comprising a tube with the lower auxiliary handle 10A on the front of the tube near the bottom and an upper auxiliary handle 11 near the top of the tube on the back. The scoop 12A at the bottom of tube 2A is rectangular in shape and has a bottom edge 18A. A plurality of adjacent, substantially parallel members 26A extend forwardly from the bottom edge. The scoop has a pair of inwardly directed vertical flanges 64 and 66. A cover 62 comprising a metal plate is slidably received over the scoop behind flanges 64 and 66. Cover 62 is connected to the inner handle, the exposed top portion 32A of which is shown. By raising or lowering the portion 32A of the inner handle, the cover 62 alternatively opens or closes scoop 12A.

Figure 5:
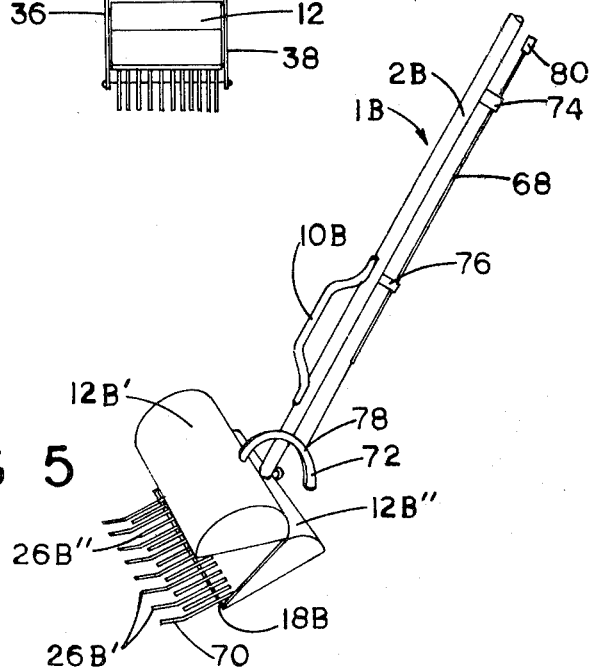
FIG. 5 is an isometric view of a further embodiment of the invention having a clamshell-like scoop and cover.

FIG. 5 shows an implement 1B for collecting pet manure according to a further embodiment of the invention. The same numbers have been used for parts equivalent to those in FIGS. 1 to 3, but the letter "B" has been added. In the case of the embodiment of FIG. 5, there is a pair of hingedly connected clamshell scoops 12B' and 12B''. There are two sets 26B' and 26B'' of wire-like members extending forwardly from the bottom edge 18B of the scoop 12B''. The members of the sets alternate with each other. The members of set 26B' have outer ends distal scoop 12B'' which extend outwardly beyond the corresponding outer ends of the members of set 26B''. The outer ends of the members of set 26B' are bent adjacent the outer ends of set 26B'' so as to be angled upwardly relative to the members of set 26B'' when the implement is positioned for use as shown.

The top clamshell scoop 12B' comprises a cover for the bottom scoop 12B''. There is a mechanism for moving the cover comprising a lever 72 connected to the top clamshell scoop and a rod 68 slidable received by the guides 74 and 76 mounted on handle 2B. The lower end 78 of the rod is pivotally connected to lever 72.

Implement 1B is used in a manner similar to the embodiment of FIGS. 1 to 3. However, the outer ends of the first set 26B' of wire-like members are angled upwardly and are consequently adapted to first fit under the manure and then deflect or roll the manure onto the back portion of the members of set 26B' and the members of set 26B'' as handle 2B is tilted rearwardly. Because only every second member extends forwardly, there are fewer members to fit under the manure and possibly break it up or spread it. However, the closer spacing of the members adjacent the edge 18B of the scoop gives additional support to the manure as it moves towards the scoop. The upward angle of the outer ends of the members of set 26B' means that these members are inclined when the bottom of scoop 12B'' is flat on the ground and so makes it easier to lift the manure from the ground and deflect or roll it towards the scoop.

The cover 12B' is closed simply by pulling upwardly on the handle 80 connected to the top end of the rod 68. This pulls upwardly on lever 72 and closes the cover.

With all of the embodiments described above, the wire-like members can be used as a rake to first loosen refuse or recover it from under shrubs and the like. These members also make recovery of refuse easy in grass or snow. The snow falls through between the members. The members can also be used to destroy remnants of the refuse by a side-to-side rubbing action.

The invention has been found to be particularly useful in collecting and removing dog manure.

The combination of the wire-like members with the covered scoop is important because, while the members are well adapted for initial recovery of the refuse, the scoop is desirable to carry the refuse to a toilet, or other disposal site, with assurance that no portion will be lost on the way.

What is claimed is:

1. An implement for collecting pet manure and similar refuse comprising:

an elongate handle with a bottom end;

a scoop mounted at the bottom end of the handle and having a bottom edge;

a cover;

means for moving the cover to cover the scoop; and a plurality of adjacent, generally parallel members extending forwardly from the bottom edge of the scoop, the members being wire-like, permitting the members to be inserted under the manure and then lift the manure when the handle is raised, the parallel members being in two sets, the members of the two sets alternating with each other, the members of a first said set extending outwardly beyond the members of a second said set.

2. An implement as claimed in claim 1 comprising a pair of hingedly connected clamshell scoops, the parallel members being mounted along a bottom edge of a bottom said clamshell scoop, a top said clamshell scoop comprising said cover.

3. An implement as claimed in claim 2, the means for moving the cover comprising a lever connected to the top clamshell scoop and a rod slidably mounted on the elongate handle, the rod having a lower end pivotally connected to the lever.

4. An implement as claimed in claim 1, the parallel members having outer ends distal from the scoop, the members of the first set being bent adjacent the outer ends of the members of the second set so as to be angled upwardly relative to the members of the second set when the implement is positioned for use, the outer ends of the first set being adapted to fit under the manure and roll the manure towards the scoop, the members of the second set giving additional support to the manure as it moves towards the scoop.

* * * * *